United States Patent [19]

Henke

[11] Patent Number: 4,489,970

[45] Date of Patent: Dec. 25, 1984

[54] APPARATUS FOR LIFTING HEAVY METAL PLATE MATERIALS

[75] Inventor: John R. Henke, Kansas City, Mo.

[73] Assignee: Dean Research Corporation, Kansas City, Mo.

[21] Appl. No.: 501,254

[22] Filed: Jun. 6, 1983

[51] Int. Cl.[3] ..... B66C 1/22

[52] U.S. Cl. ..... 294/67 AB; 294/83 R; 294/103 R

[58] Field of Search ..... 294/67 R, 67 A, 67 AB, 294/67 D, 67 DB, 67 BB, 67 EA, 78 R, 78 A, 81 R, 82 R, 83 R, 103 R

[56] References Cited

U.S. PATENT DOCUMENTS

| | | | |
|---|---|---|---|
| 1,272,359 | 7/1918 | Bell | 294/103 R |
| 2,441,026 | 5/1948 | Long | 294/81 R X |
| 2,744,780 | 5/1956 | Dixon | 294/67 EA X |
| 3,219,216 | 11/1965 | Pinaud | 294/81 R X |
| 4,181,341 | 1/1980 | Henke | 294/67 R |

FOREIGN PATENT DOCUMENTS

| | | | |
|---|---|---|---|
| 761413 | 9/1980 | U.S.S.R. | 294/67 AB |

*Primary Examiner*—Johnny D. Cherry

*Attorney, Agent, or Firm*—Schmidt, Johnson, Hovey & Williams

[57] ABSTRACT

A lifting apparatus is provided that is especially designed for gripping and lifting oversized, heavy metal plate materials. Metal plates in a horizontal position may be lifted and deposited in upright disposition in a bin therefor, and then retrieved from such bin and returned to a horizontal location for use or work thereon. The apparatus includes first and second, opposed, hook-shaped grippers for abuttably engaging opposed marginal ends of a metal plate to be lifted, and a webbed belt reaved around the grippers in a manner to urge the grippers into plate engaging relationship. One of the two grippers includes guide structure that provides for selective engagement and disengagement of at least one of the grippers from a plate or plates thus facilitating insertion and removal of the apparatus from bin stored upright stacks of plates in closely spaced relationship.

19 Claims, 8 Drawing Figures

34
32
10
120
44
62
26
66
64
48
116
60
50
42
56
58
52
84
56
88
30
90
94
98
96
112
114
110
106
74
80
100
118
104
82
78
76
28
140
139
67
68
122
156
138
72
152
149

74
80
30
118
78
76
82
7.
128
122
140
142
124
144
126
130
139
134
133
132
138
136
8.
67
156
152
150
154
149
72
147
146
70

28
128
142
122
140
144
67
12
124
134
136
158
133
130
132
138
72
149
16
150
156
154
146
147
70

34
32
10
120
48
30
26
62
44
46
50
60
52
58
54
84
86
58
90
92
96
98
98
94
114
110
112
114
106
108
74
78
100
102
142
128
122
126
124
144
139
160
133
158
132
28
152
70
68
149

APPARATUS FOR LIFTING HEAVY METAL PLATE MATERIALS

BACKGROUND OF THE INVENTION

1. Field of the Invention

This invention relates to mechanisms for lifting sheet material, and in particular relates to a lifting mechanism especially designed for handling oversized, metal panels or plates which are to be moved to and from upright storage bins.

2. Description of the Prior Art

Mechanisms for handling sheet materials such as large metal plates are well known. U.S. Pat. No. 3,976,321 assigned to the assignee hereof and entitled "Sheet Material Handling Apparatus", and my U.S. Pat. No. 4,181,341 entitled "Apparatus for Lifting Sheet Material", for instance, disclose mechanisms suitable for handling standard-sized metal sheet materials. Those skilled in the art will realize that sheet materials are most advantageously stacked in an upright orientation, and as such the beforementioned lifting mechanisms disclose upper and lower grippers, in the form of hooks, for engaging the upper and lower marginal ends of the panel to be lifted. It is a feature of such lifting mechanisms that the lower gripper member or hook is provided with means for engaging and disengaging the lower hook from the lower marginal end of the lifted panel or panels in order to provide for selective engagement and disengagement of the lifting mechanisms with a panel. The mechanism for engaging and disengaging the lower hook must have the capability of remote control, since it is generally not safe for an operator to place himself between upright panels.

U.S. Pat. No. 3,976,321, for example, discloses a lifting mechanism provided with relatively complicated and therefore somewhat expensive mechanism for relatively swinging the lower gripping hooks of the lifting mechanism into and out of positions for engaging and disengaging the lower marginal end of a vertically stacked, sheet-like plate or panel. U.S. Pat. No. 4,181,341 also discloses a less costly, more trouble free lifting mechanism wherein the lower gripping hooks have initially sheet clearing cocked positions such that upon release they are capable of pivoting into a position wherein they are disposed for engaging the lower marginal end of a lifted panel. The lifting mechanism of the U.S. Pat. No. 4,181,341, with its pivotal lower hooks, has proven to be an excellent, cost-effective tool for the lifting of standard sized metal plates or panels. Lifting mechanism having pivotal lower hooks as taught in the U.S. Pat. No. 4,181,341, however, is limited to some extent in its load capacity, since it is axiomatic that some of the structural integrity of a hook must be sacrificed in order to provide for the hook to have the ability to be pivotally shifted.

There are instances wherein oversized, heavy sheet metal panels or plates each weighing up to 15,000 pounds or more are required to be lifted and transported. The unit for lifting and moving the sheets, either singly or in multiple, must be capable of handling horizontal as well as upright sheets with equal facility, even if the upright sheets are in closely adjacent stacks. A lifting mechanism which has the ability to be engaged and disengaged by remote control from generally vertically oriented metal plates, but which at the same time has a lower gripping hook that requires no pivoting parts inherently has a decided advantage in handling such oversized, heavy plates.

SUMMARY OF THE INVENTION

The problems outlined above are in large measure solved by the lifting apparatus in accordance with the present invention. That is to say, the lifting apparatus hereof is capable of lifting oversized, heavy panels, and includes the ability to be selectively engaged or disengaged by remote control from a generally vertically oriented panel without requiring pivoting of the lower gripping hook. More particularly, the lifting apparatus hereof includes a pair of upper and lower gripping members for engaging the upper and lower marginal ends of a heavy, oversized panel, a web interconnecting the gripping members for urging the members together into panel engaging relationship, and shiftable guide structure which enables the lower gripping element to be selectively engaged or disengaged from an adjacent marginal end of a lifted panel. The guide structure eliminates the requirement of having a pivotal or shiftable lower gripping hook, thereby enabling the lower gripping hook to be constructed in sturdy, one-piece form. The lifting mechanism hereof is equally well adapted for attachment to and disengagement from generally horizontal as well as upright, oversized metal panels.

DETAILED DESCRIPTION OF THE DRAWINGS

Figure 1:
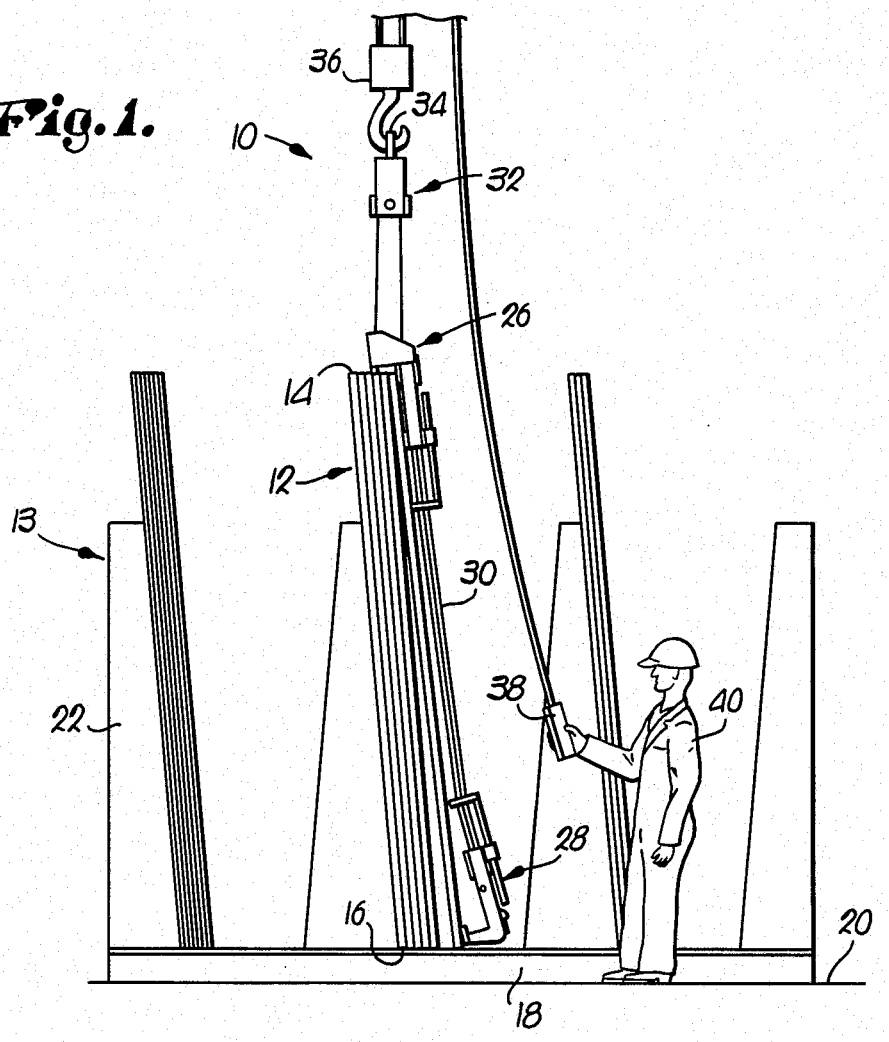
FIG. 1 is an elevational view of one type of storage rack adapted to receive vertically oriented, oversized metal plates stored therein, and illustrating a lifting mechanism in accordance with the present invention which is being moved toward a position for engaging plates.

Referring to the drawings, FIG. 1 depicts lifting apparatus 10 in accordance with the present invention in conjunction with a plurality of oversized, heavy metal plates 12 that are located within a vertical storage rack 13. Each plate 12 in stored disposition has upper and lower marginal ends 14 and 16 respectively, and the storage rack 13 includes a pair of lowermost rails 18 for supporting the lower marginal ends 16 of the plates 12 in spaced relationship above the floor 20 of a storage area. The rack 13 also is provided with a plurality of upright standards 22 which have upright, opposed support edges which may for example be slanted at about 5° to the vertical.

The lifting apparatus 10 in accordance with the present invention broadly includes upper and lower gripping members 26, 28, and a web 30 reaved about the upper and lower gripping members 26, 28 so as to present three web stretches interconnecting the gripping members. The web 30 is supported at its uppermost reach by block assembly 32 which includes an eyelet 34 engageable with overhead hook 36. The hook 36 may be raised and lowered by remote control device 38 located for convenient operation by a worker 40 while he stands on floor 20 adjacent the storage rack 13.

Figure 3:
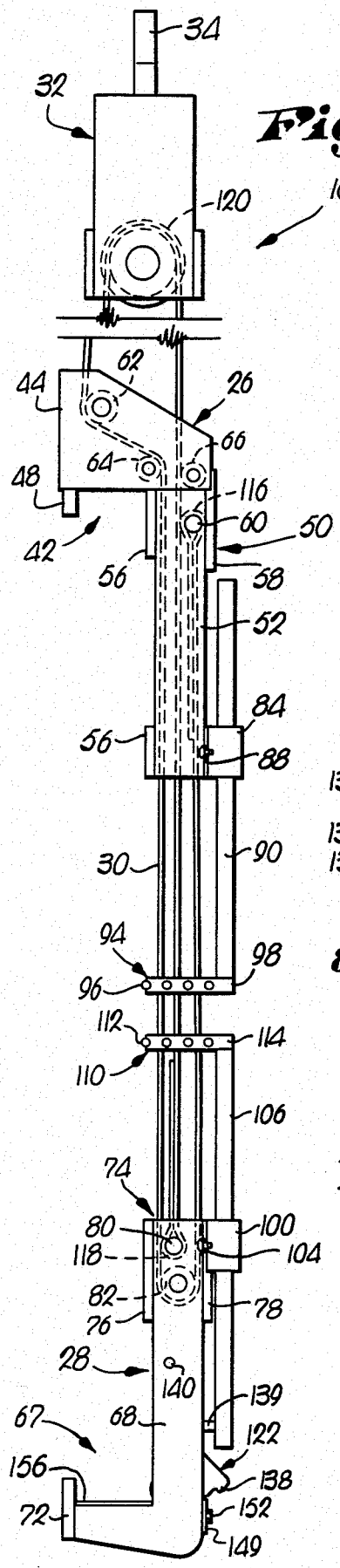
FIG. 3 is an enlarged, fragmentary, side view of lifting apparatus constructed in accordance with the present invention.
Figure 4:
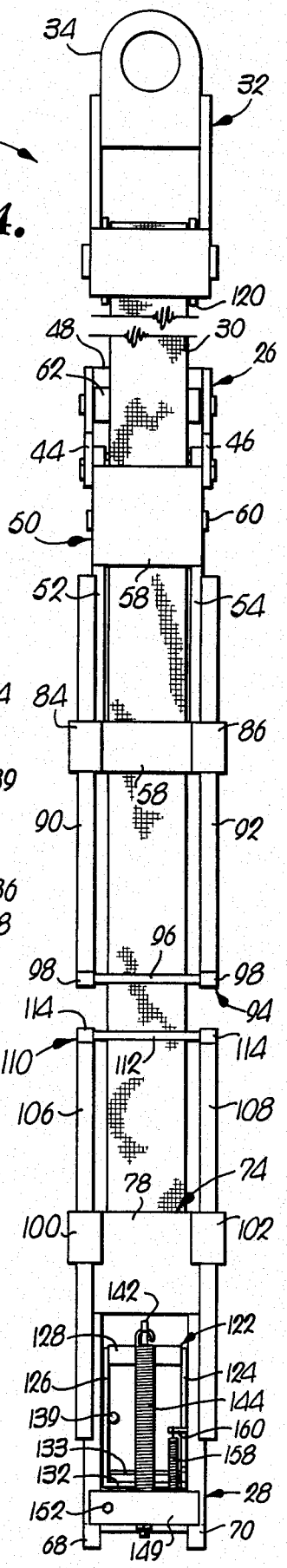
FIG. 4 is an enlarged, fragmentary, rear view of a lifting apparatus embodying the novel features of the present invention.

Referring in particular to FIGS. 3 and 4, upper gripping member 26 includes structure defining a downward facing hook mouth 42 including a pair of spaced-apart side plates 44, 46, front plate 48, and web guide 50. Web guide 50 is made up of spaced-apart side panels 52, 54 and split front and back panels 56, 58. A web retention rod 60 is journaled between the upper web guide side panels 52, 54, and a plurality of web-supporting rollers 62, 64, 66 are journaled between the upper hook side plates 44, 46.

The lower gripping member 28 (FIGS. 3, 5 and 6) includes structure defining an upwardly directed hook mouth 67 comprising a pair of spaced-apart, L-shaped side plates 68, 70, and front plate 72. The lower gripping member 28 has a web guiding portion 74 defined by the upper section of the L-shaped side plate 68, 70, a front panel 76 and a back panel 78. A web retention rod 80 and web-supporting roller 82 spaced therebelow in parallel relationship are journaled between L-shaped side plates 68, 70.

A pair of tubular sleeves 84, 86 (FIGS. 3 and 4), each having a set screw 88, are fixedly connected to the lower section of upper web guide back panel 58. Elongated rods 90, 92 are received within respective sleeves 84, 86 and held in place by set screws 88. A web guiding grate 94 is fixedly connected to and carried between the rods 90, 92 and includes a plurality of rods 96 journalled between side supports 98. Similarly, back panel 78 of lower gripping member 28 includes a pair of tubular sleeves 100, 102, each having a set screw 104. Elongated rods 106, 108 are received within respective sleeves 100, 102 and held in place by set screws 104. A second web-guiding grate 110 is fixedly connected to and carried by the rods 106, 108 and includes a plurality of rods 112 journaled between side supports 114.

Referring to FIG. 3, web 30 is preferably comprised of woven nylon or similar fabric having a significant strength to weight factor and includes a pair of looped terminal ends 116, 118. Terminal end 116 is fixedly secured to web-retention rod 60, and terminal end 118 is fixedly secured to web-retention rod 80. Web 30 is reaved from retention rod 60 of the upper gripping member 26 around web roller 82 of the lower gripping member 28, continuous again upwardly around upper gripping member web rollers 62, 64, around a pulley 120 carried by block assembly 32 and finally extends downwardly through upper gripping member 26 to lower gripping member web retention rod 80.

Figure 5:
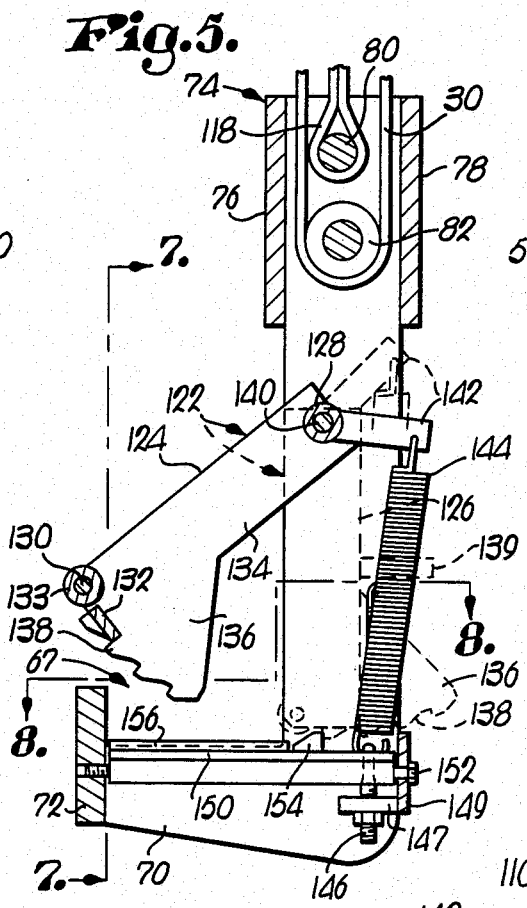
FIG. 5 is a longitudinal sectional view of the lower gripping member of a lifting apparatus in accordance with the present invention, phantom lines depicting the guide structure in its retained, plate clearing position.
Figure 6:
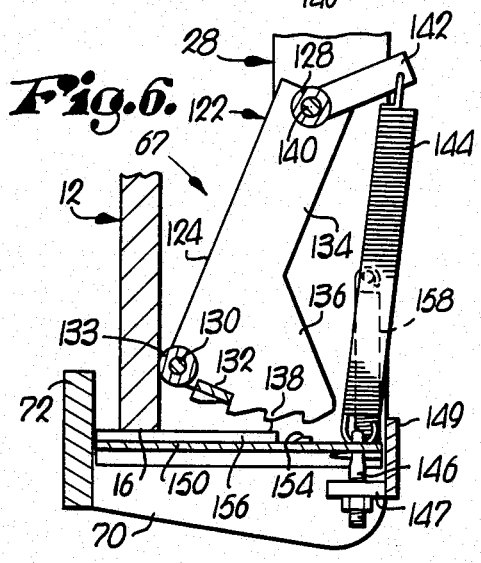
FIG. 6 is a fragmentary, longitudinal sectional view of the lower gripping member of a lifting apparatus in accordance with the present invention, and a metal plate engaged and carried thereby.

Guide structure 122 is pivotally carried by the lower gripping member 28 and includes a pair of shiftable arms 124, 126 fixedly coupled together by tubular sleeve 128, rod 130, and bar 132. A roller 133 is received on rod 130. Arm 124 has an elongated portion 134 and a flared out portion 136 which terminates in a plurality of integral, downwardly directed ratchet teeth 138. Referring especially to FIGS. 4 and 5, it will be noted that arm 126 of guide structure 122 which is of rectangular configuration and depicted in phantom lines has a rearwardly facing cylindrical stub 139 projecting from the rear edge thereof intermediate the upper and lower ends of the arm. The guide structure 122 is mounted on the lower gripping member 28 through the medium of a support rod 140 pivotally received within sleeve 128. The support rod 140 is journaled between the L-shaped side plates 68, 70 of the lower gripping member 28.

A spring support arm 142 (FIG. 6) is fixedly connected to guide structure sleeve 128. Guide structure biasing spring 144 is secured at one end to the spring support arm 142, and at its opposed end to eyelet 146 projecting upwardly from tab 147 extending inwardly from the rear plate 149 of structure 122.

Figure 8:
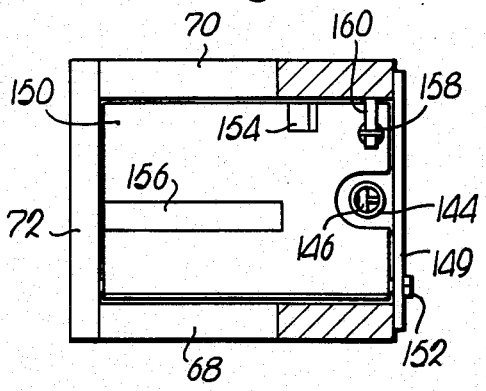
FIG. 8 is a sectional view taken along the line 8—8 of FIG. 5.

A treadle 150 (FIG. 8) is pivotally carried by elongated bolt 152 of lower gripping member 28. The treadle includes a pawl 154 and an upwardly facing projection 156 on its upper surface. A biasing spring 158 is attached at one end to the treadle 150, and at its opposed end to fixture 160 fixedly connected to L-shaped side plate 70 of lower gripping element 28.

In operation, lifting mechanism 10 is readied to engage and lift a panel 12 by cocking the guide element 122, against the biasing force of spring 144. Stub 139 projecting outwardly from guide element arm 126 may advantageously receive a tubular actuator (not shown) for effecting the cocking of the guide structure 122 which is accomplished by lifting up on the actuator to rotate stub 139 and thereby arms 124 and 126 in a counterclockwise direction viewing FIG. 5. Once the guide structure 122 is shifted rearwardly by the cocking action described above, one of the ratchet teeth 138 will engage the ratchet pawl 154, thereby retaining the guide structure 122 in its cocked position. It will be appreciated in this regard that the spring 158 associated with the treadle 150 biases the treadle 150 upwardly such that the pawl 154 is kept in engagement with one of the ratchet teeth until released.

The lifting mechanism 10 may be shifted into proximity to a plate 12, once the guide structure 122 is cocked and retained by the pawl 154. The overhead hook 36 may be manipulated via remote control device 38 to position the lifting mechanism 10 adjacent the plate 12 desired to be lifted. It will be appreciated that the lifting mechanism thereof may be used to lift either horizontally oriented plates 12 or plates which are stacked in storage bin 13. In this event, lifting mechanism 10 is employed to lift one or more plates 12 laying on a horizontal pallet or other similar support, the guide structure 122 should be cocked and retained as described above, the lower gripping member 28 placed at one marginal end of the horizontal plates, and the upper gripping member 26 placed at the opposed marginal end of such plates. Raising of the block 32 will urge the gripping members 26, 28 toward each other, and as the block 32 is raised further, the horizontally oriented plate will be lifted into an upright disposition.

The particular way in which web 30 is reaved between upper and lower gripping members 26, 28 causes the gripping members 26, 28 to be urged together when the gripping members 26, 28 are lifted and subjected to the force of gravity. It will be noted, however, that the web grates 94, 110 supported by rods 84, 86, 106, 108, will abuttingly engage when the lifting mechanism 10 is raised without a plate being engaged between the gripping members 26, 28, thereby preventing the gripping members 26, 28 from coming into direct contact. It will be appreciated that, due to the abutting engagement of the grate numbers 94, 110 a significant length of the web 30 will be presented in the three stretches of web 30 between the gripping members 26, 28. In this regard, if the grates 94, 110 and support bars 84, 86, 106, 108 were removed, the length of the web 30 between the gripping members 26, 28 would be shifted so as to increase the distance between the upper gripping member 26 and the block assembly 32. The abutting engagement of the grates 94, 110, therefore, cuts down on the overhead height required to accommodate the lifting mechanism 10. Note that the positions of the grates 94, 110 may be shifted relative to their respective gripping members by adjusting the positions of rods 84, 86, 106, 108 within sleeves 84, 86, 100, 102 thus providing accommodation for plates of different effective widths.

After the lifting mechanism 10 has been shifted into position adjacent a stack of vertically oriented plates 12 using remote control unit 38, and as the lifting mechanism 10 is lowered, the upper gripping member 26 will engage the upper marginal edge 14 of at least one of the vertically stacked plates 12. The lower gripping member 28, however, will continue to descend toward the floor 20 under the influence of gravity. When the hook defining plate 72 of lower gripping member 28 falls below the lower marginal edge 16 of a plate 12, the gripping member 28 will swing beneath the plate or plates 12 under the influence of gravity, so as to come into alignment with the lower marginal edge 16 of at least one plate 12. As depicted in FIG. 1, the plates may be separated from each other at the lower marginal end 16 to facilitate the engagement of the lower gripping member 28 with the lower marginal end 16 of the selected plate. Furthermore, due to the plurality of ratchet teeth 138 carried by the guide structure 122, the latter may be positioned within the mouth 67 of lower gripping member 28 so as to engage the outermost adjacent plate 12 and allow the gripping member 28 to shift under only a preselected number of stacked panels 12. For example, it can be appreciated from FIGS. 5 and 6 that if structure 122 is rotated through an arc to cause the first tooth 138 adjacent roller 133 to engage locking pawl 154, the hook 67 will swing beneath a greater number of plates 12 than is the case when structure 122 is swung to an extent to cause the rearmost tooth 138 to engage the pawl.

Figure 2:
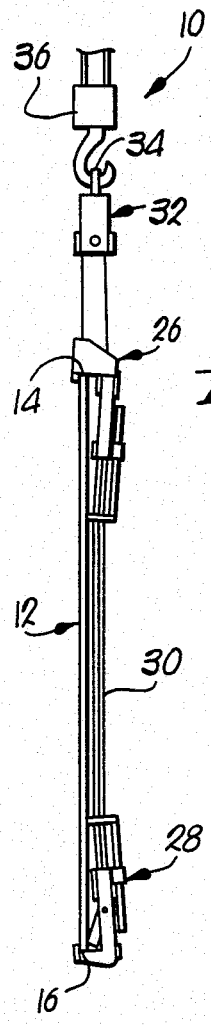
FIG. 2 is a side elevational view of lifting apparatus in accordance with the present invention with a single plate engaged thereby.
Figure 7:
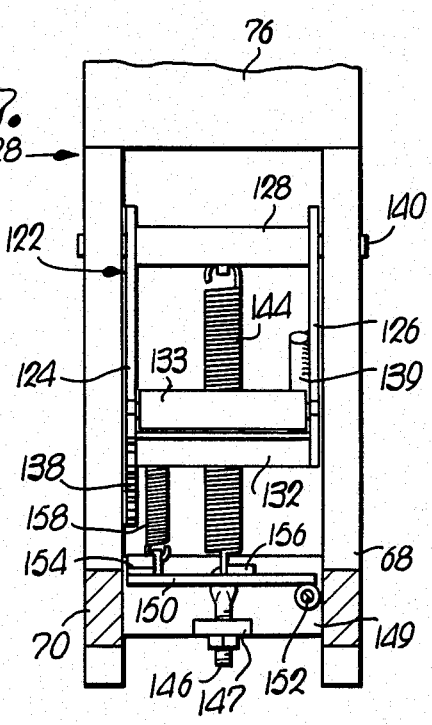
FIG. 7 is a sectional view taken along the lines 7—7 of FIG. 5.

The overhead hook 36 may be raised once the lower gripping member 28 is aligned beneath the lower marginal end 16 of at least one plate 12. Raising of the hook 36 will cause the web 30 to urge the gripping members 26, 28 toward each other in panel gripping relationship. Once a panel is gripped between the gripping members 26, 28, further raising of the hook 36 will cause the entire lifting mechanism 10, and selected plate 12, to be raised out of the storage rack 13. Engagement of the lower gripping member 28 with the lower marginal end 16 of a plate 12 causes the treadle 150 to be depressed against the biasing force of spring 158. Depression of the treadle 150 releases the pawl 154 from a tooth 138 of guide structure 122, permitting the guide structure 122 to shift into abutting engagement with the panel 12 under the biasing influence of spring 144 (see FIG. 6). The mechanism 10 and plate 12 may thereby be transported by the overhead hook 36, in the configuration as depicted in FIG. 2, to a second storage rack in a designated work area or laid down horizontally in a desired location.

If mechanism 10 is being used to move one or more plates 12 into upright disposition in rack or bin 13, the lower gripping member 28 will descend to the floor 20 of the work area under the influence of gravity after the lower marginal end 16 of the plate 12 engages the rails 18 of a support rack, and the overhead hook 36 is further lowered. The plate 72 defining the upwardly facing hook mouth 67 of lower gripping member 28 will eventually clear the lower marginal end 16 of the plate 12 as the lower gripping member 28 descends. The biasing force of spring 144 on guide structure 122 will therefore urge the lower gripping member 28 away from the panel 12, and the guide element 122 will shift into a position wherein the mouth 67 of the lower gripping element 28 is essentially covered by the guide structure 122 (see FIG. 5). Once the guide structure is in the position depicted in FIG. 5, guide structure 122 will engage the plate 12, urging the gripping member 28 away from the plate 12, thereby preventing engagement of the lower marginal end 16 of the panel 12 by the lower gripping member 28. The lower gripping member 28 may then be raised by the upward shifting of overhead hook 36, out of the storage rack without reengaging the lower marginal end 16 of the plate 12.

The guide structure 122 also aids in the disengagement of the lifting mechanism 10 from plate 12, if the plate 12 is to be placed in horizontal orientation. Once the plate 12 is fully lowered into a horizontal position, the overhead hook 36 may be lowered so as to release the tension on web 30. The lower gripping hook 28 may then be manually shifted out of engagement with the marginal end 16 of plate 12, and the guide structure will shift under the influence of spring 144, as described above. Overhead hook 36 may then be raised, and the guide structure 122 prevents reengagement of the marginal end of plate 12 by lower gripping member 28.

I claim:

1. Apparatus for lifting one or more relatively heavy, generally unwieldy plates comprising:

first engagement means for operably engaging one marginal end of a plate or adjacent marginal ends of a plurality of stacked plates;

second engagement means for operably engaging a second opposed marginal end of said plate or the adjacent opposed marginal ends of said plurality of plates;

means interconnecting said first and second engagement means and operable to move the same toward each other into plate engaging relationship;

guide means operably associated with one of said plate engagement means and movable from a position allowing said one plate engagement means to engage one or more of said plates, to a location preventing the one plate engagement means from contacting a respective adjacent marginal end or ends of a plate or plates when the first and second engagement means are allowed to shift away from each other to an extent to cause said one engagement means to clear the corresponding adjacent marginal end or ends of the plate or plates, and then moved toward each other through a displacement that said one engagement means would reengage the proximal marginal end or ends of the plate or plates if it were not for the guide means being in said location thereof; and means for shifting one of said first and second plate engagement means in a direction out of lifting engagement with said one or more plates when lifting thereof is completed and the one of said plate engagement means associated with said shifting means is shifted away from the adjacent margin of said one or more plates.

2. Apparatus as set forth in claim 1, wherein said guide means includes components operable to limit the extent of movement of said one engagement means toward the plates when a plurality thereof are to be engaged and thereafter lifted to limit engagement of said one engagement means to a preselected number of said plates.

3. Apparatus as set forth in claim 1, wherein said one engagement means includes a gripping member presenting a hook mouth and said guide means includes arm structure shiftable into and out of said hook mouth to restrict engagement of the gripping member to a preselected number of plates in stacked relationship.

4. Apparatus as set forth in claim 3, wherein said arm structure includes ratchet tooth defining means and pawl means engageable with selected teeth of the ratchet means, and means for facilitating shifting of the arm structure through a displacement to bring a selected tooth into engagement with the pawl means.

5. Apparatus as set forth in claim 1, wherein said guide means includes mechanism operable to releasably maintain the guide means in said position thereof and effective to release the guide means from said position for shifting of the same toward said location thereof as a result of engagement of said one engagement means with a plate or plates followed by relative movement of the first and second engagement means away from each other to an extent that at least said one engagement means is free of engagement with said plate or plates.

6. Apparatus as set forth in claim 5, wherein said guide means includes arm means having tooth defining means thereon, pawl means engageable with the tooth defining means to hold the guide means in said position allowing said one plate engagement means to engage one or more of said plates, and treadle means coupled to said pawl means and located to be contacted by the marginal end or ends of the plate or plates engaged by said one engagement means to shift the pawl means out of restraining relationship with said tooth defining means of the arm means.

7. Apparatus as set forth in claim 6, wherein is provided means normally biasing the guide means away from said position allowing said one plate engagement means to engage one or more of said plates toward the location thereof preventing the one plate engagement means from contacting a respective marginal end or ends of a plate or plates.

8. Apparatus as set forth in claim 1, wherein said means interconnecting the first and second engagement means comprises a web reaved about said first and second engagement means in a pattern causing the first and second engagement means to move toward one another when a force is exerted on one of the engagement means in a direction tending to move the engagement means on which such force is exerted away from the other engagement means.

9. Apparatus as set forth in claim 8, wherein said first and second plate engagement means include mutually abuttable spacing means thereon for maintaining a predetermined minimum spacing between respective plate engaging portions of said first and second engagement means.

10. Apparatus as set forth in claim 9, wherein is provided means adjustably mounting the spacing means on the first and second engagement means respectively to permit selective variation of minimum spacing therebetween.

11. Apparatus as set forth in claim 1, said shifting means including means for biasing the plate engagement means associated therewith away from said one or more plates.

12. Apparatus for lifting a plurality of relatively heavy, generally unwieldy plates comprising:

first engagement means for operably engaging the adjacent marginal ends of a plurality of stacked plates;

second engagement means for operably engaging the adjacent opposed marginal ends of said plurality of plates;

means interconnecting said first and second engagement means and operable to move the same toward each other into plate engaging relationship; and guide means operably associated with one of said plate engagement means and movable from a location preventing said one plate engagement means for engaging adjacent marginal ends of the stack of plates, to a position allowing said one plate engagement means to engage the adjacent marginal ends of only a selected number of the plates, said one engagement means including a gripping member presenting a hook mouth and said guide means includes arm structure shiftable into and out of said hook mouth to any one of a number of preselected positions to thereby rstrict engagement of the gripping member to the selected number of plates in said stack thereof.

13. Apparatus as set forth in claim 12, wherein said arm structure includes ratchet tooth defining means and pawl means engageable with a selected tooth of the ratchet means corresponding with the desired position of the arm structure in said hook mouth of the gripping member.

14. Apparatus as set forth in claim 13, wherein is provided an extension on said arm means located to be engaged by an actuating tool which may be manually manipulated to shift the arm structure through a displacement to bring a selected tooth into engagement with the pawl means.

15. Apparatus as set forth in claim 13, wherein is provided means for automatically releasing the pawl means from restraining engagement with the ratchet means upon movement of the gripping member into engagement with a selected number of said plates.

16. Apparatus for lifting one or more relatively heavy, generally unwieldy plates comprising:

first engagement means for operably engaging one marginal end of a plate or adjacent marginal ends of a plurality of stacked plates;

second engagement means for operably engaging a second opposed marginal end of said plate or the adjacent opposed marginal ends of said plurality of plates;

means interconnecting said first and second engagement means and operable to move the same toward each other into plate engaging relationship; and guide means operably associated with one of said plate engagement means and movable from a position allowing said one plate engagement means to engage one or more of said plates, to a location preventing the one plate engagement means from contacting a respective adjacent marginal end or ends of a plate or plates when the first and second engagement means are allowed to shift away from each other to an extent to cause said one engagement means to clear the corresponding adjacent marginal end or ends of the plate or plates, and the moved toward each other through a displacement that said one engagement means would reengage the proximal marginal end or ends of the plate or plates if it were not for the guide means being in said location thereof, said guide means including components operable to limit the extent of movement of said one engagement means toward the plates when a plurality thereof are to be engaged and thereafter lifted to limit engagement of said one engagement means to a preselected number of said plates.

17. Apparatus for lifting one or more relatively heavy, generally unwieldy plates comprising:

first engagement means for operably engaging one marginal end of a plate or adjacent marginal ends of a plurality of stacked plates;

second engagement means for operably engaging a second opposed marginal end of said plate or the adjacent opposed marginal ends of said plurality of plates;

means interconnecting said first and second engagement means and operable to move the same toward each other into plate engaging relationship; and guide means operably associated with one of said plate engagement means and movable from a position allowing said one plate engagement means to engage one or more of said plates, to a location preventing the one plate engagement means from contacting a respective adjacent marginal end or ends of a plate or plates when the first and second engagement means are allowed to shift away from each other to an extent to cause said one engagement means to clear the corresponding adjacent marginal end or ends of the plate or plates, and then moved toward each other through a displacement that said one engagement means would reengage the proximal marginal end or ends of the plate or plates if it were not for the guide means being in said location thereof, said one engagement means including a gripping member presenting a hook mouth and said guide means includes arm structure shiftable into and out of said hook mouth to restrict engagement of the gripping member to a preselected number of plates in stacked relationship.

18. Apparatus for lifting one or more relatively heavy, generally unwieldy plates comprising:

first engagement means for operably engaging one marginal end of a plate or adjacent marginal ends of a plurality of stacked plates;

second engagement means for operably engaging a second opposed marginal end of said plate or the adjacent opposed marginal ends of said plurality of plates;

means interconnecting said first and second engagement means and operable to move the same toward each other into plate engaging relationship; and guide means operably associated with one of said plate engagement means and movable from a position allowing said one plate engagement means to engage one or more of said plates, to a location preventing the one plate engagement means from contacting a respective adjacent marginal end or ends of a plate or plates when the first and second engagement means are allowed to shift away from each other to an extent to cause said one engagement means to clear the corresponding adjacent marginal end or ends of the plate or plates, and then moved toward each other through a displacement that said one engagement means would reengage the proximal marginal end or ends of the plate or plates if it were not for the guide means being in said location thereof, said guide means including mechanism operable to releasably maintain the guide means in said position thereof and effective to release the guide means from said position for shifting of the same toward said location thereof as a result of engagement of said one engagement means with a plate or plates followed by relative movement of the first and second engagement means away from each other to an extent that at least said one engagement means is free of engagement with said plate or plates.

19. Apparatus for lifting one or more relatively heavy, generally unwieldy plates comprising:

first engagement means for operably engaging one marginal end of a plate or adjacent marginal ends of a plurality of stacked plates;

second engagement means for operably engaging a second opposed marginal end of said plate or the adjacent opposed marginal ends of said plurality of plates;

means interconnecting said first and second engagement means and operable to move the same toward each other into plate engaging relationship; and guide means operably associated with one of said plate engagement means and movable from a position allowing said one plate engagement means to engage one or more of said plates, to a location preventing the one plate engagement means from contacting a respective adjacent marginal end or ends of a plate or plates when the first and second engagement means are allowed to shift away from each other to an extent to cause said one engagement means to clear the corresponding adjacent marginal end or ends of the plate or plates, and then moved toward each other through a displacement that said one engagement means would reengage the proximal marginal end or ends of the plate or plates if it were not for the guide means being in said location thereof, said means interconnecting the first and second engagement means comprising a web reaved about said first and second engagement means in a pattern causing the first and second engagement means to move toward one another when a force is exerted on one of the engagement means in a direction tending to move the engagement means on which such force is exerted away from the other engagement means.

* * * * *